United States Patent [19]

Brandis

[11] 3,991,989

[45] Nov. 16, 1976

[54] MOVEMENT DIRECTION REVERSAL DEVICE

[75] Inventor: Curt Brandis, Totensen, Germany

[73] Assignee: Fried. Krupp Gesellschaft mit beschraenkter Haftung, Essen, Germany

[22] Filed: Mar. 19, 1975

[21] Appl. No.: 560,084

[30] Foreign Application Priority Data

Mar. 21, 1974 Germany ..... 24135544

[52] U.S. Cl. ..... 267/75; 267/137; 188/280; 267/126

[51] Int. Cl.[2] ..... F16F 15/02

[58] Field of Search ..... 267/116, 137, 124, 125; 267/127, 166, 174, 75; 83/215, 216, 217, 223, 314, 353, 752, 526, 925 CC; 251/48, 53, 284, 285; 188/311, 297, 280; 139/144, 145, 133

[56] References Cited

UNITED STATES PATENTS

| | | | |
|---|---|---|---|
| 3,237,574 | 3/1966 | Smith et al. | 267/116 |
| 3,510,117 | 5/1970 | Scholin et al. | 267/116 |
| 3,864,997 | 2/1975 | Pearl et al. | 83/925 CC |

*Primary Examiner*—James B. Marbert
*Attorney, Agent, or Firm*—Spencer & Kaye

[57] ABSTRACT

A direction reversal device including a housing and an abutment rod passing through, and movable relative to, the housing, one of the housing and the rod being stationary and the other being arranged to be impacted by a moving unit whose direction of travel is to be reversed, the device also including a resilient connection disposed between the rod and the housing and arranged to have a potential energy storage capacity corresponding to the kinetic energy possessed by the moving unit, and control elements for adjusting the storage capacity and the location of the point of direction reversal of the device.

12 Claims, 4 Drawing Figures

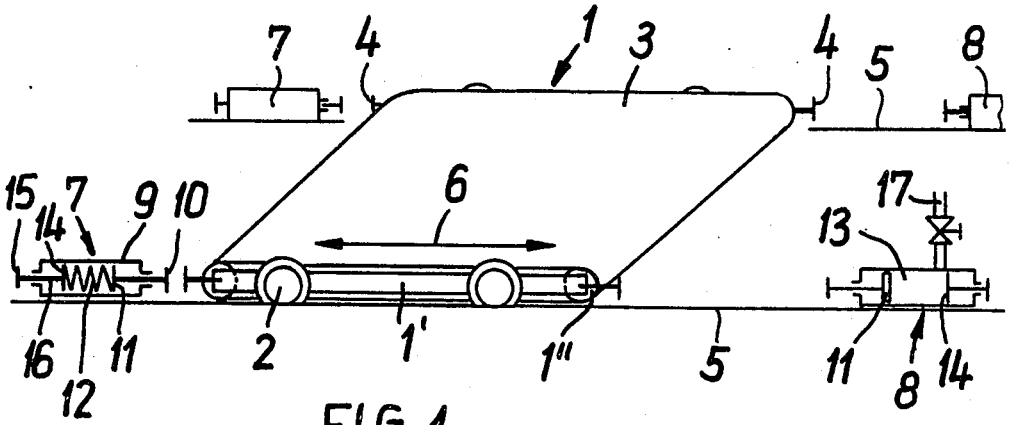
FIG. 1
FIG. 2
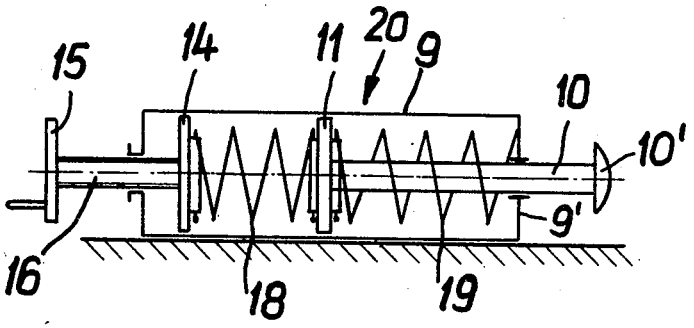
FIG. 3
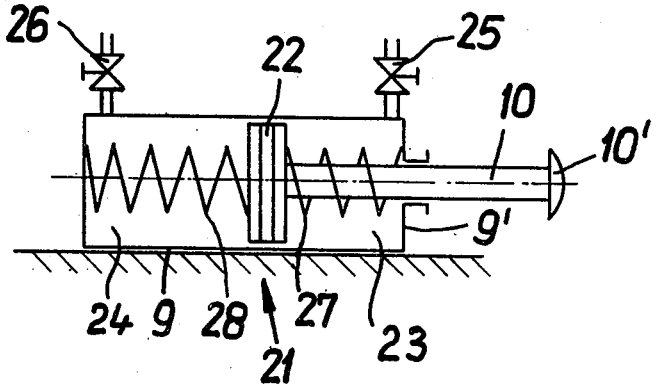

MOVEMENT DIRECTION REVERSAL DEVICE

BACKGROUND OF THE INVENTION

The present invention relates to a direction reversal device for units which undergo back and forth movement, such as layering tables or similar changing units, particularly in textile machines, the device including at least one abutment rod which is movable with respect to a housing, and a resilient connection located between these abutting components and arranged to be effective in their longitudinal direction.

These various systems equipped with layering tables or other changing units which must undergo constant back and forth movement and in which the changes in direction of movement at the points of reversal desirably take place as abruptly as possible.

Consequently, high acceleration forces must be produced at the points of reversal.

Because of the sudden change in the direction of movement at the points of reversal, high stresses are imposed on the moving members and high output loads are placed on the associated drive units.

In order to keep the coats required for moving the layering tables within tenable limits, the components which are moved have been designed to be as lightweight as possible and, in addition, compromises had to be made regarding the reversal movement.

It has already been proposed to reduce the effect of the above-described drawbacks by the provision of resilient abutments at the points of reversal which take over part of the work required for reversing the direction of movement. These abutments have the drawback, however, that they can be optimally designed only for layering tables in certain speed ranges and the locations of the points of reversal change when there is a change in the speed of movement of the table.

When the speed of the table is increased, the locations of the points of reversal are displaced outwardly, i.e., the layering tables or changing devices execute a longer stroke.

SUMMARY OF THE INVENTION

It is therefore an object of the present invention to avoid the above-described drawbacks to a substantial degree.

This is achieved by the provision of a novel reversing device which is adaptable to varying speed conditions, i.e., which maintains the locations of the points of reversal constant over a range of movement speeds.

The objects of the present invention are achieved by giving the reversal device a potential energy storage capability — which is expressed in terms of the displacement of the components acting as abutments, when the layering table is being decelerated, with respect to the associated stationary component — which corresponds approximately to the kinetic energy transmitting by the layering table and by enabling the energy storage capability as well as the position of the point of direction reversal of the abutment component to be adjusted.

Preferably each abutment rod is supported, via a disc which can be moved within the housing, on a spring device which counteracts the catching, or deceleration, movement, the spring characteristic of the spring and its final position being adjustable and the spring itself being held by the adjacent housing countersurface.

In a particularly advantageous embodiment of the present invention, the spring device is held at a countersurface of the housing through the intermediary of an abutment which can be varied in position with respect to the associated housing, thus varying the position of the associated end of the spring device. According to a further embodiment of the present invention, each abutment rod is additionally supported on a brake spring device which opposes the reversal movement of the abutment component.

The spring device may also be designed in a known manner as a mechanical spring which yields in the axial direction of the abutment rod.

It is also possible, however, to design the reversal device so that each one of the spring devices is a gas cushion whose expansion is limited by the disc of the abutment rod, the disc being in the form of a piston.

The quantity of gas forming the gas cushion can be varied by means of an adjustable gas pressure source connected, via a control line, with the housing chamber occupied by the gas. By changing the pressure in the gas chamber, it is possible to achieve a simple remote control of the operating capability of the gas cushion and the point of reversal of the abutment component, and thus of the layering table.

Instead of the gas cushion it is also possible to employ a liquid cushion composed of a volume of liquid in communication with a liquid accumulator via a pressure line.

When gas or liquid cushions are employed as the spring devices, an additional spring may be provided between the piston and the associated countersurface, the interaction of this spring determining the starting position of the abutment component.

The reversal device may include in a known manner a unidirectionally acting abutment rod. The abutment rod, whose free end is designed as an abutment surface, then passes out of the housing on the side facing the layering table, the housing being stationarily disposed outside of the range of movement of the layering table in the area of one point of reversal.

The reversing device may preferably also be designed so that the housing serves as a double acting abutment mounted on, and movable along the length of, the abutment rod, while the abutment rod extends out of both ends of the housing and is stationarily disposed within the range of movement of the layering table. This embodiment has the advantage that the number of reversal devices required for one layering table is cut in half.

Further significant features and characteristics of the present invention will be described below for embodiments which are illustrated in the drawings.

BRIEF DESCRIPTION OF THE DRAWING

FIG. 1 is a simplified pictorial perspective view of a layering table mounted between four reversal devices according to the invention.

FIG. 2 is a simplified cross-sectional view of an embodiment of a reversal device according to the invention provided with springs, one of which springs is supported on an adjustable abutment.

FIG. 3 is a simplified cross-sectional view of a pneumatically resilient reversal device according to the invention which is additionally provided with springs for fixing the starting position of the associated abutment rod.

DESCRIPTION OF THE PREFERRED EMBODIMENTS

Figure 4:
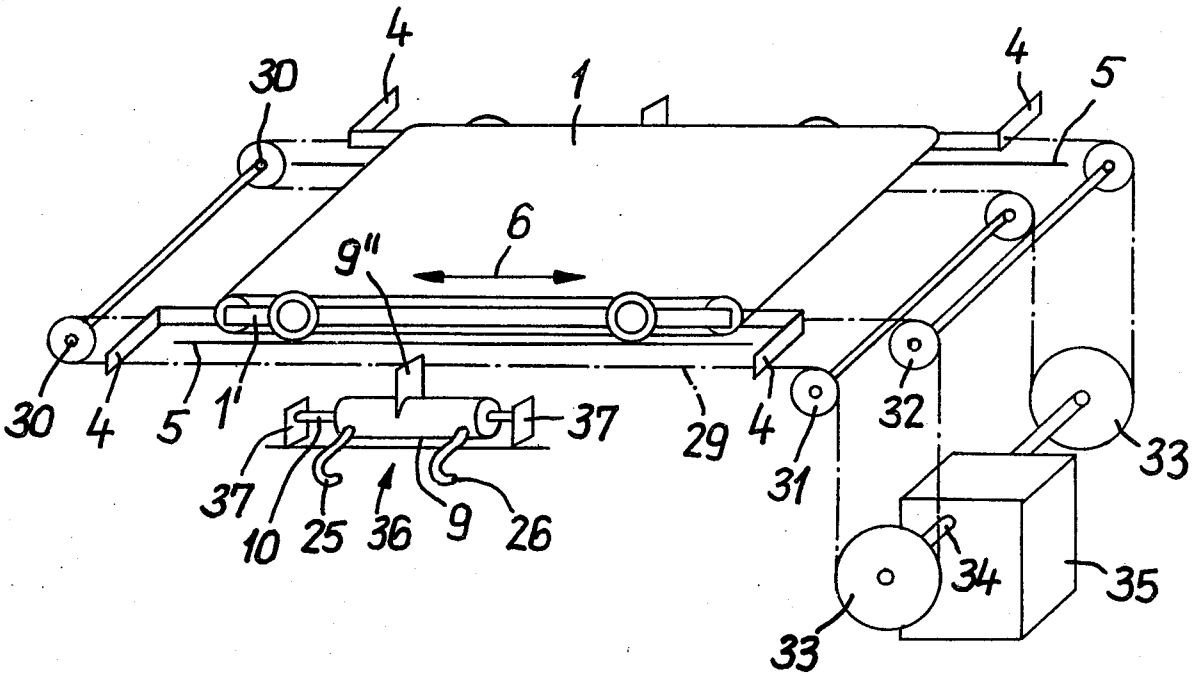
FIG. 4 is a simplified perspective view of a layering table with the associated drive device and reversal devices according to the invention which are effective in both directions of movement of the layering table.

FIG. 1 illustrates a layering table 1 which includes a frame 1′ provided with wheels 2 and with guide rollers 1″ rotatably mounted at the outer ends of the frame 1′. A continuous jacket, or belt, 3 of a flexible material passes around, and is supported between, the guide rollers 1″. The layering table 1, which is provided with members defining abutment surfaces 4 in the region of each of the guide rollers 1″, is moved back and forth over a path 5 in the direction of arrow 6. The layering table may be driven by any known driving device, which is therefore not illustrated in FIG. 1.

At each side of table 1, a reversal device 7 is disposed at one point of direction reversal for the back and forth movement of the layering table 1 and a reversal device 8 is disposed at the other point of direction reversal therefor. Each of the four reversal devices 7, 8 is positioned to cooperate with a respective one of the abutment surfaces 4 of the layering table.

Reversal device 7 includes an abutment rod 10 displaceably mounted in a stationary housing 9 and supported via a disc 11 against a spring 12. Device 8 includes a similar abutment rod supported via a disc 11 against a gas cushion 13. The spring 12 is supported on an abutment 14 in the embodiment 7, while abutment 14 constitutes the other boundary of cushion 13 in embodiment 8. In either embodiment, abutment 14 is adjustable with respect to housing 9.

The adjustment of abutment 14 can be effected, for example, as shown for device 7, by rotating a threaded spindle 16 which is provided with a hand wheel 15 and which coacts with a mating thread in a passage at the end of housing 9.

The gas chamber 13 for the abutment 8, which chamber is limited by the disc 11 in the form of a piston and the abutment 14, is additionally connected to a control line 17. This control line permits the gas pressure in chamber 13 to be adjusted to effect a remote control of the point of reversal and of the operating capability of the gas cushion.

The spring device on which the abutment rod 10 is supported via disc 11 on the adjustable abutment 14, may be in the form of a mechanical spring 18, as shown for the reversal device 20 of FIG. 2.

The disc 11, which is designed as a cup spring, in the embodiment 20 of FIG. 2, is additionally engaged, on the side facing the abutment surface 10′ of the abutment rod 10, by a brake, or recoil, spring 19. This spring 19 is held against the frontal wall 9′ of the housing 9 which serves as a countersurface.

The housing countersurface may, however, also be made adjustable — depending on the configuration of the abutment 14.

The reversal device 20 shown in FIG. 2 has the advantage compared to the reversal device 7, that the spring dimensions and spring characteristics can be adjusted within wider limits.

This is possible because both springs 18 and 19 operate in parallel relative to each other so that their spring constants are additive. Moreover, both springs can be prestressed between the surface 9 and 14 so that storing of energy will not begin at zero but at a finite spring force. Hence, the deflections will be shorter for the same storage effect.

In the embodiment of a pneumatically resilient reversal device 21 shown in FIG. 3, the disc which is connected with abutment rod 10 is designed as a double-acting piston 22. This piston divides the interior of housing 9 into two gas chambers 23 and 24 which are connected to control lines 25 and 26, respectively.

The gas cushions present in chambers 23 and 24 act against one another in a manner analogous to counteracting mechanical springs. The opposing relationship between the cushions has the additional effect that the normally hyperbolic characteristics of the individual gas springs are substantially linearized.

In this case the precise location of the point of direction reversal of the abutment rod 10 and the operating capacity of the gas springs can also be varied by changing the gas pressure. Furthermore, the control lines 25 and 26 permit remote control of the operating characteristics of the reversal device 21.

The double-acting piston 22 is additionally supported on both sides by mechanical springs 27 and 28, respectively, whose opposite ends abut against respective opposite end faces of housing 9. When identical pressure exists in chambers 23 and 24, springs 27 and 28 determine the starting position of the double-acting piston 22 and thus of the abutment rod 10.

FIG. 4 illustrates a layering table arrangement in which table 1 is connected on each side, via extensions of frame 1′, with a chain or belt 29 which passes around a drive wheel 33, outside of the range of movement of the layering table 1, and around guide rollers 30, 31 and 32. The drive wheels 33 are connected with a drive unit 35 via a shaft 34, the drive unit including a motor-driven switching gear. The direction of rotation of the gear mechanism is varied in a known manner via limit switches (not shown) so that the layering table performs the back and forth movement indicated by arrow 6.

The four abutment surfaces 4 in this embodiment are angled, stiffened abutment struts.

On each side of layering table 1 there is provided a reversal device 36 which is disposed between the abutment struts 4 on the associated side of the layering table.

The reversal device 36 includes a housing 9 which is provided with an abutment member 9″ and which is movably guided on abutment rod 10. Abutment rod 10 extends the length of housing 9 and protrudes from both ends thereof. Rod 10 is held stationary by being supported at both ends by stationary uprights 37.

The resilient connection between the abutment rod 10 and housing 9 — as mentioned above — is effected by gas cushions. The associated gas chambers, which are separated by a double-acting piston (not shown) similar to piston 22 of FIG. 3 and mounted on abutment rod 10, are connected to a controllable pressure network via flexible control lines 25 and 26.

Since the reversal device 36 serves to catch the layering table in both directions of movement, it is designed almost completely symmetrically in the normal case, i.e., the two sections of the reversal device which lie to the left and right of the abutment member 9″ are essentially identical to one another.

The resilient connection between the housing 9, which serves as an abutment, and the stationarily held abutment rod 10 may also — as explained in connection with the preceding embodiments — be designed to operate mechanically, hydraulically or as a combination thereof.

The size of the springs is determined proceeding from the spring constant C and the allowable deflection $s$ from the rest position of the spring in the direction of compression. The former must be sufficient for retarding and accelerating the layering table within the specified time. The latter must be sufficiently large to prevent overloading of the spring even at maximum table speed.

The following relationship exists for the overall operation:

The potentional energy of the two springs (e.g., 7 in FIG. 1) in the fully compressed position when reaching the end position is equal to the kinetic energy of the layering speed $v$ $$\frac{c}{2} \cdot s^2 = \frac{m}{2} \cdot v^2; \; m\text{: reciprocating mass}$$

or $$s = \sqrt{\frac{m}{c} \cdot v}$$

It appears that the spring deflection during compression s increases in proportion to the layering speed.

If the point of rest of the spring buffer is constant for all speeds, then the position of the reversing point changes, i.e., the higher the speed, the farther outwards is the reversing point in accordance with the increase in deflection $s$. In the invention, this is compensated for by displacing the point of rest inwards with the aid of the positive stop 14 as the layering speed increases.

The same effect is obtained with the gas storage unit 8 by changing the position of the counter piston 14. In this case, the stored energy is given by $$\int_o^s p \cdot A \cdot ds$$

where $p$ = gas pressure $A$ = surface of piston so that inward displacement of the reversing point can be brought about not only by shifting the counter piston 14 but also by increasing the gas pressure $p$ in the rest position with increasing gas pressure the storage capacity of the storage unit also increases.

For example, if the layering table has a weight of $m =$ 200 kg and is moved at a speed of $v = 60$ m/min, $= 1$ m/sec. then with a spring constant (for both springs of one side in accordance with storage unit 7) of $c = 400$ N/cm = 40.000 N/m we have a deflection of $$s = \sqrt{\frac{200}{40.000} \cdot 1} = 0.0707 \text{ m}$$

$$s = 7.07 \text{ cm}$$

The springs must be designed in accordance with the usual relationships of stress analysis so that they will not be overloaded at this deflection.

At a layering speed of $v_1 = 30$ m/min = 0.5 m/sec, we have $$s_1 = \sqrt{\frac{200}{40.000} \cdot 0.25}$$

$$s_1 = 1.77 \text{ cm}$$

In order to obtain the same reversing point for this speed as for 60 m/min, the stops 14 must therefore be moved inwards by $7.07 - 1.77 = 5.3$ cm.

It will be understood that the above description of the present invention is susceptible to various modifications, changes and adaptations, and the same are intended to be comprehended within the meaning and range of equivalents of the appended claims.

I claim:

1. A device for reversing the direction of movement of a unit which undergoes back and forth movements over a travel path with abrupt direction reversals at the end points of its travel path, the device including a first member constituting a housing, a second member constituting an abutment rod mounted for movement relative to the housing in a direction between opposed ends of the housing, support means holding one of the members stationary, the older member being arranged to be impacted by the unit at the commencement of such direction reversal, and means establishing a resilient connection between one end of the housing and the rod to influence the characteristics of the relative movement therebetween, the improvement wherein said means establishing a resilient connection gives said device a total potential energy storage capacity approximately equal to the kinetic energy given up by the unit as it undergoes such a change in direction while in contact with said device, and said device comprises means for adjusting the energy storage capacity and the location of the point of direction reversal provided by said device.

2. A device as defined in claim 1, further comprising a disc element connected to said abutment rod, and wherein said means establishing a resilient connection are operatively disposed between said disc element and one end of said housing in a manner to produce a force between said rod and said housing in a direction opposing the force exerted on said other member by the unit at the time of impact when the unit is traveling toward said device.

3. A device as defined in claim 2 further comprising means defining a bearing surface located within said housing, and delimiting the end of said resilient connection means associated with said one end of said housing, and wherein said adjusting means include means disposed between said bearing surface means and said housing for permitting adjustment of the distance between said bearing surface means and said one end of said housing.

4. A device as defined in claim 2 further comprising resilient counterforce applying means disposed between said disc element and an end of said housing in a manner to produce a force between said rod and said housing in a direction opposite to that produced by said means establishing a resilient connection.

5. A device as defined in claim 2 wherein said housing defines a cylinder, said disc constitutes a piston defining, with said one end of said housing, a fluid space in said cylinder, and said means establishing a resilient connection comprise a body of fluid filling said space.

6. A device as defined in claim 5 wherein said fluid is a gas.

7. A device as defined in claim 6 wherein said means for adjusting comprise a conduit communicating with said space for permitting the quantity of gas therein to be adjusted.

8. A device as defined in claim 5 wherein the fluid is a liquid and said means establishing a resilient connection further comprise a liquid accumulator and a conduit connected between said space and the interior of said accumulator.

9. A device as defined in claim 5 further comprising a mechanical spring connected between said disc and one end of said housing for determining the rest position of said abutment rod relative to said housing.

10. A device as defined in claim 1 wherein one end of said abutment rod extends through one end of said housing and presents an abutment surface located outside of said housing and arranged to be directed toward one end of the unit, said device being arranged to be located beyond one end of the travel path of the unit in the region of one end point of such travel path.

11. A device as defined in claim 1 wherein each longitudinal end of said abutment rod extends through a respective end of said housing and further comprising support means connected to the ends of said rod to hold said rod stationary and impact means rigidly connected to said housing at a location to be impacted by the unit at each end of its travel path, for causing said housing to move along said rod while absorbing the energy of such impact.

12. A device for reversing the direction of movement of a layering table in a textile machine, which table undergoes back and forth movements over a travel path with abrupt direction reversals at the end points of its travel path, the device including a first member constituting a housing, a second member constituting an abutment rod mounted for movement relative to the housing in a direction between opposed ends of the housing, support means holding one of the members stationary, the other member being arranged to be impacted by the table at the commencement of such direction reversal, and means establishing a resilient connection between one end of the housing and the rod to influence the characteristics of the relative movement therebetween, the improvement wherein said means establishing a resilient connection gives said device a total potential energy storage capacity approximately equal to the kinetic energy given up by the table as it undergoes such a change in direction while in contact with said device, and said device comprises means for adjusting the energy storage capacity and the location of the point of direction reversal provided by said device.

* * * * *